US007875576B2

(12) United States Patent
Boffa

(10) Patent No.: US 7,875,576 B2
(45) Date of Patent: Jan. 25, 2011

(54) LUBRICATING OIL COMPOSITION FOR INTERNAL COMBUSTION ENGINES

(75) Inventor: Alexander B. Boffa, Richmond, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 1066 days.

(21) Appl. No.: 10/901,671

(22) Filed: Jul. 29, 2004

(65) Prior Publication Data

US 2006/0025313 A1 Feb. 2, 2006

(51) Int. Cl.
*C07F 5/04* (2006.01)
*C01G 39/06* (2006.01)
*C10M 159/12* (2006.01)

(52) U.S. Cl. ..... 508/199; 508/167; 508/329

(58) Field of Classification Search ..... 508/199, 508/167, 329
See application file for complete search history.

(56) References Cited

U.S. PATENT DOCUMENTS

| | | | | |
|---|---|---|---|---|
| 2,992,708 | A | 7/1961 | Lyon | |
| 3,018,250 | A | 1/1962 | Anderson et al. | |
| 3,018,291 | A | 1/1962 | Anderson et al. | |
| 3,024,237 | A | 3/1962 | Drummond et al. | |
| 3,100,673 | A | 8/1963 | Ulmer et al. | |
| 3,172,892 | A | 3/1965 | Le Suer et al. | |
| 3,202,678 | A | 8/1965 | Stuart et al. | |
| 3,219,666 | A | 11/1965 | Norman et al. | |
| 3,272,746 | A | 9/1966 | Le Suer et al. | |
| 3,361,673 | A | 1/1968 | Stuart et al. | |
| 3,368,972 | A | 2/1968 | Otto | |
| 3,381,022 | A | 4/1968 | Le Suer | |
| 3,496,105 | A | 2/1970 | Le Suer | |
| 3,539,663 | A | 11/1970 | Pietrusza et al. | |
| 3,649,229 | A | 3/1972 | Otto | |
| 3,779,928 | A | 12/1973 | Schlicht | |
| 3,909,430 | A | 9/1975 | Hotten | |
| 3,912,764 | A | 10/1975 | Palmer, Jr. | |
| 3,933,659 | A | 1/1976 | Lyle et al. | |
| 3,968,157 | A | 7/1976 | Hotten | |
| 4,105,571 | A | 8/1978 | Shaub et al. | |
| 4,152,499 | A | 5/1979 | Boerzel et al. | |
| 4,157,309 | A | 6/1979 | Wilgus et al. | |
| 4,234,435 | A * | 11/1980 | Meinhardt et al. | 508/192 |
| 4,263,152 | A * | 4/1981 | King et al. | 508/226 |
| 4,455,243 | A | 6/1984 | Liston et al. | |
| 4,495,088 | A | 1/1985 | Liston et al. | |
| 4,530,771 | A * | 7/1985 | Nakano et al. | 508/198 |
| 4,612,132 | A | 9/1986 | Wollenberg et al. | |
| 4,702,859 | A | 10/1987 | Shimizu et al. | |
| 4,746,446 | A | 5/1988 | Wollenberg et al. | |
| 4,747,965 | A | 5/1988 | Wollenberg et al. | |
| 5,112,507 | A | 5/1992 | Harrison | |
| 5,137,978 | A | 8/1992 | Degonia et al. | |
| 5,137,980 | A | 8/1992 | Degonia et al. | |
| 5,175,225 | A | 12/1992 | Ruhe, Jr. | |
| 5,241,003 | A | 8/1993 | Degonia et al. | |
| 5,266,186 | A | 11/1993 | Kaplan | |
| 5,286,799 | A | 2/1994 | Harrison et al. | |
| 5,319,030 | A | 6/1994 | Harrison et al. | |
| 5,334,321 | A | 8/1994 | Harrison et al. | |
| 5,356,552 | A | 10/1994 | Harrison et al. | |
| 5,523,417 | A | 6/1996 | Blackborow et al. | |
| 5,565,528 | A | 10/1996 | Harrison et al. | |
| 5,625,004 | A | 4/1997 | Harrison et al. | |
| 5,629,272 | A | 5/1997 | Nakazato et al. | |
| 5,716,912 | A | 2/1998 | Harrison et al. | |
| 5,777,025 | A | 7/1998 | Spencer et al. | |
| 5,792,729 | A | 8/1998 | Harrison et al. | |
| 6,114,288 | A * | 9/2000 | Fujitsu et al. | 508/371 |
| 6,203,584 | B1 | 3/2001 | Fuentes-Allick et al. | |
| 6,358,892 | B1 * | 3/2002 | Harrison et al. | 508/192 |
| 6,562,765 | B1 | 5/2003 | Boffa | |
| 6,696,393 | B1 | 2/2004 | Boffa | |
| 2002/0119895 | A1 * | 8/2002 | Cook et al. | 508/186 |
| 2003/0096716 | A1 * | 5/2003 | Locke et al. | 508/525 |

FOREIGN PATENT DOCUMENTS

| | | |
|---|---|---|
| EP | 0 542 380 | 5/1993 |
| EP | 0 355 895 | 12/1994 |
| EP | 0 602 863 | 5/1997 |
| EP | 1 167 497 A2 | 1/2002 |
| EP | 1 416 035 A2 | 5/2004 |
| EP | 1 418 220 A2 | 5/2004 |
| EP | 1 422 286 A1 | 5/2004 |

* cited by examiner

*Primary Examiner*—Walter D Griffin
*Assistant Examiner*—Frank C Campanell
(74) *Attorney, Agent, or Firm*—Claude J. Caroli; M. Carmen & Associates, PLLC

(57) ABSTRACT

Disclosed herein is a lubricating oil composition comprising a) major amount of a base oil of lubricating viscosity; b) from about 0.1 to 10 wt % of an overbased alkaline earth metal alkyl aryl sulfonate detergent having a total base number (TBN) of about 25 to 500; c) from about 0.02 to 10 wt % of a oxymolybdenum-containing complex of a nitrogen-containing compound; d) from about 0.1 to 5 wt % of a friction modifier; and e) from about 0.2 to 10 wt % of an antioxidant selected from the group consisting of a diphenylamine type, a sulfurized ester-containing compound and mixtures thereof; wherein the total concentration of the oxymolybdenum-containing complex and antioxidant must be at least 1.3 wt %, based on the total weight of the lubricating oil composition and wherein the phosphorus content of the total lubricating oil composition is 0.08 wt % or less, based on the total weight of the lubricating oil composition.

56 Claims, No Drawings

LUBRICATING OIL COMPOSITION FOR INTERNAL COMBUSTION ENGINES

The present invention relates to a lubricating oil composition for internal combustion engines. More particularly, the present invention relates to a lubricating oil composition having a low phosphorus content that improves fuel economy while also providing high temperature oxidation, piston deposits, and wear.

BACKGROUND OF THE INVENTION

Auto manufacturers continue to request improved fuel economy performance and robustness of future motor oils. For example, the International Lubricant Standardization and Approval Committee (ILSAC) GF-4 specification (final standard was released Jan. 14, 2004 and revised Jun. 1, 2004) requires improvement in fuel economy, high temperature oxidation, high temperature piston deposit, and wear relative to ILSAC GF-3. The ILSAC GF-4 specifies the minimum performance requirements (both engine sequence and bench tests) and chemical and physical properties for those engine oils that vehicle manufacturers deem necessary for satisfactory equipment performance and life.

In addition, ILSAC GF-4 limits the amount of phosphorus to 0.08 wt % in the finished oil. This puts restrictions on the use of zinc dialkyldithiophosphate, a commonly used wear control additive having favorable characteristics as an anti-wear additive. However, a problem has arisen with respect to the use of zinc dialkyldithiophosphate, because phosphorus and sulfur derivatives poison catalyst components of catalytic converters. This is a major concern as effective catalytic converters are needed to reduce pollution and to meet governmental regulations designed to reduce toxic gases such as, for example, hydrocarbons, carbon monoxide and nitrogen oxides, in internal combustion engine exhaust emission. Such catalytic converters generally use a combination of catalytic metals, e.g., platinum or variations, and metal oxides, and are installed in the exhaust streams, e.g., the exhaust pipes of automobiles, to convert the toxic gases to nontoxic gases. As previously mentioned, these catalyst components are poisoned by the phosphorus and sulfur components, or the phosphorus and sulfur decomposition product of the zinc dialkyldithiophosphate; and accordingly, the use of engine oils containing phosphorus and sulfur additives may substantially reduce the life and effectiveness of catalytic converters. Therefore, it would be desirable to reduce the phosphorus and sulfur content in the engine oils so as to maintain the activity and extend the life of the catalytic converter.

Simultaneously balancing ILSAC GF-4 requirements is difficult given that additives typically used to control piston deposits are often detrimental for fuel economy and wear. Through a series of formulation appetite studies, unique combinations of additives have been discovered allowing competing requirements to be satisfied.

Accordingly, as demand for further decrease of the phosphorus content and a limit on the sulfur content of lubricating oils is very high, this reduction cannot be satisfied by the present measures in practice and still meet the severe anti-wear and oxidation-corrosion inhibiting properties, as well as cleanliness (i.e., deposit protection) required of today's engine oils. Thus, it would be desirable to develop lubricating oils, and additives and additive packages therefore, having lower levels of phosphorus and sulfur but which still provide the needed wear, oxidation-corrosion and deposit protection now provided by lubricating oils having, for example, higher levels of zinc dialkyldithiophosphate, but which do not suffer from the disadvantages of the lubricating oils discussed above.

U.S. Pat. No. 6,696,393, issued Feb. 24, 2004 to Boffa, discloses methods and lubricant compositions for reducing wear in internal combustion engines lubricated with a low phosphorus content lubricating oil. The lubricant compositions comprise a synergistic combination of a complex of a molybdenum/nitrogen containing compound and at least one phosphorus-containing compound wherein the total phosphorus employed in the composition is no more than about 0.06 weight percent based on the total weight of the composition.

U.S. Pat. No. 6,562,765, issued May 13, 2004 to Boffa, discloses an engine oil having a base oil and a friction reducing amount of an oil soluble sulfurized or unsulfurized oxymolybdenum complex prepared from reacting, in the presence of a polar promoter, an acidic molybdenum compound and a basic nitrogen compound and a low concentration of a sulfurized oxymolybdenum dialkyldithiocarbamate; employed together to provide at least 450 parts per million of molybdenum and less than 175 parts per million of molybdenum from the dialkyldithiocarbamate, both on the basis of the engine oil.

SUMMARY OF THE INVENTION

The present invention relates to a lubricating oil composition for internal combustion engines which demonstrates improved fuel economy. More particularly, the present invention relates to a low phosphorus lubricating oil composition employing a base oil of lubricating viscosity, a sulfonate detergent, oxymolybdenum-containing complex, a friction modifier and an antioxidant to achieve the fuel economy benefits demonstrated in the lubricating oil composition while also providing high temperature oxidation, piston deposits, and wear.

Accordingly, in its broadest aspect, the present invention relates to a lubricating oil composition comprising:

a) major amount of a base oil of lubricating viscosity;

b) from about 0.1 to 10 wt % of an overbased alkaline earth metal alkyl aryl sulfonate detergent having a total base number (TBN) of about 25 to 500;

c) from about 0.02 to 10 wt % of a oxymolybdenum-containing complex;

d) from about 0.1 to 5.0 wt % of a friction modifier; and e) from about 0.2 to 10 wt % of an antioxidant selected from the group consisting of a diphenylamine type, a sulfur-containing compound and mixtures thereof;

wherein the total concentration of the oxymolybdenum-containing complex and antioxidant must be at least 1.3 wt %, based on the total weight of the lubricating oil composition and wherein the phosphorus content of the total lubricating oil composition is 0.08 wt % or less, based on the total weight of the lubricating oil composition.

The lubricating oil composition of the present invention may further contain an oil-soluble, phosphorus-containing, anti-wear compound and an alkenyl succinimide dispersant derived from a 450 to 3000 average molecular weight polyalkylene.

As mentioned above, the lubricating oil composition of the present invention provides improved fuel economy while also providing high temperature oxidation, piston deposits, and wear. Accordingly, the present invention is further directed to a method for improving the fuel economy of an internal combustion engine, preferably gasoline, comprising operating said engine with the lubricating oil composition of the present invention.

Among other factors, the present invention is based upon the surprising discovery that a certain combination of additive components in a low phosphorus lubricating oil composition provides an improvement in fuel economy in comparison to other conventional lubricating oil compositions. More specifically, the low phosphorus lubricating oil composition employing a base oil of lubricating viscosity, sulfonate detergent, a oxymolybdenum-containing complex, a friction modifier and an antioxidant have shown to improve fuel economy while also providing high temperature oxidation, piston deposits, and wear. Therefore, employing such a lubricating oil composition in an engine oil application, gear oil application or other application requiring lubrication, can lead to an improvement in overall fuel economy.

DETAILED DESCRIPTION OF THE INVENTION

As mentioned above, the fuel economy of an internal combustion engine is improved by employing a certain combination of a base oil of lubricating viscosity, a sulfonate detergent, a oxymolybdenum-containing complex, a friction modifier and an antioxidant in a low phosphorus lubricating oil composition having less than 0.08 wt % phosphorus content, based on the total weight of the lubricating oil composition.

Each of these components employed in the lubricating oil composition of the present invention will be described in detail herein below. However, prior to such description, the following terms have the following meanings unless expressly stated to the contrary.

The term "alkaline earth metal" means calcium, barium, magnesium, strontium, or mixtures thereof.

The term "hydrocarbyl" means an alkyl or alkenyl group.

The term "metal" means alkali metals, alkaline earth metals, or mixtures thereof.

The term "an oil-soluble, phosphorus-containing, anti-wear compound" refers to additives in lubricant compositions that contain phosphorus and which exhibit an anti-wear benefit, either alone or when used in combination with other additives, during operation of an internal combustion engine that is lubricated with such a lubricant composition. The phosphorus in such additives is typically integral to the additive function.

The term "total phosphorus" refers to the total amount of phosphorus in the lubricant composition regardless of whether such phosphorus is present as part of an oil-soluble, phosphorus-containing, anti-wear compound or in the form of a contaminant in the lubricant composition such as residual phosphorus remaining due to the presence of $P_2S_5$ used to prepare metal dihydrocarbyl dithiophosphates. In either event, the amount of phosphorus permitted in the lubricant composition is independent of source. Preferably, however, the phosphorus is part of a lubricant additive.

The term "Total Base Number" or "TBN" refers to the equivalent number of milligrams of KOH needed to neutralize 1 gram of a product. Therefore, a high TBN reflects strongly overbased products and, as a result, a higher base reserve for neutralizing acids. The TBN of a product can be determined by ASTM Standard No. D2896 or equivalent procedure.

Unless otherwise specified, all percentages are in weight percent (%).

Sulfonate Detergent

Metal detergents have widely been employed in engine oil lubricating formulations to neutralize the acidic by-products of the combustion process and/or lubricant oxidation and to provide a soap effect and keep pistons and other high temperature surfaces clean thus preventing sludge. A number of different surfactant types have been used to produce different lubricant detergents. Common examples of metal detergents included: sulfonates, alkylphenates, sulfurized alkyl phenates, carboxylates, salicylates, phosphonates, and phosphinates. Commercial products are generally referred to as neutral or overbased. Overbased metal sulfonates are generally produced by carbonating a mixture of hydrocarbons, sulfonic acid, metal oxide or hydroxides (for example calcium oxide or calcium hydroxide) and promoters such as xylene, methanol and water. For example for preparing an overbased calcium sulfonate; in carbonation, the calcium oxide or hydroxide reacts with the gaseous carbon dioxide to form calcium carbonate. The sulfonic acid is neutralized with an excess of CaO or Ca(OH) to form the sulfonate. The prior art known processes for overbasing calcium sulfonates generally produces high alkaline reserves of TBN of 300 to 400 mg KOH/gm or higher.

Also included within the meaning of "sulfonate" are the salts of sulfonic acids of synthetic alkyl aryl compounds, which often are preferred. These acids also are prepared by treating an alkyl aryl compound with sulfuric acid or sulfur trioxide. At least one alkyl substituent of the aryl ring is an oil-solubilizing group, as discussed above. The acids thus obtained are known as synthetic alkyl aryl sulfonic acids and the salts as alkyl aryl sulfonates. The sulfonates where the alkyl is straight-chain are the well-known linear alkyl aryl sulfonates. Typically these obtained by the oligo-polymerization of ethylene to $C_{14}$ to $C_{40}$ hydrocarbons followed by alkylation via a Friedel-Crafts reaction of an aryl hydrocarbon. Branched olefins can be obtained from the oligo-polymerization of, for example, propylene to $C_{15}$ to $C_{42}$ hydrocarbons and particularly the propylene tetrapolymer dimerized to a $C_{24}$ olefin, or alkylation of aromatics using normal alpha olefins. Preferred aryl groups are phenyl and substituted phenyl, preferably tolyl, xylyl, particularly ortho-xylyl, ethyl phenyl, cumenyl and the like.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acids can be neutralized directly with an alkaline earth metal base. The sulfonates may then be overbased and such overbased materials and methods of preparing such materials are known to those skilled in the art. See, for example, LeSuer U.S. Pat. No. 3,496,105, issued Feb. 17, 1970, particularly Cols. 3 and 4.

The sulfonates are present in the lubricating oil composition of the present invention in the form of alkaline earth metal salts, or mixtures thereof. The alkaline earth metals include magnesium, calcium and barium, of which calcium is preferred. The sulfonates are superalkalinized employing excess alkaline metal base carbon dioxide or other suitable base source. Often this is added sequentially or step wise addition with or without a promoter, paying particular attention to the overbasing process since improper overbasing will lead to highly viscous sulfonates or lower overbased than desired. The oil-soluble overbased alkaline earth metal alkyl aryl sulfonate detergents are overbased under suitable conditions to substantially produce from about 25 to 500 TBN, preferably from about 250 to 500 TBN, and most preferably from about 300 to 450 TBN. TBN can be measured according to ASTM D2986. Particularly preferred for overbasing are calcium oxide and/or calcium hydroxide with carbon dioxide to produce an overbased calcium sulfonate. Moreover, at these preferred TBN ranges it is preferred that the sulfonate detergent have a kinematic viscosity at 100° C. of less than 500 cSt, preferably less than 350 cSt, preferably less than 250 cSt and more preferably less than 200 cSt and even more preferably less than 180 cSt.

Particularly preferred, however, because of their wide availability, are salts of the petroleum sulfonic acids, particularly the petroleum sulfonic acids which are obtained by sulfonating various hydrocarbon fractions such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid which may or may not be alkylated; and the like.

The preferred salts for use in the present invention are those of alkylated aromatic sulfonic acids in which the alkyl radical or radicals contain at least about 8 carbon atoms, for example from about 8 to 40 carbon atoms. Another preferred group of sulfonate starting materials are the aliphatic-substituted cyclic sulfonic acids in which the aliphatic substituents or substituents contain a total of at least 12 carbon atoms, such as the alkyl aryl sulfonic acids, alkyl cycloaliphatic sulfonic acids, the alkyl heterocyclic sulfonic acids and aliphatic sulfonic acids in which the aliphatic radical or radicals contain a total of at least 12 carbon atoms. Specific examples of these oil-soluble sulfonic acids include petroleum sulfonic acid, petrolatum sulfonic acids, mono- and poly-wax-substituted naphthalene sulfonic acids, substituted sulfonic acids, such as cetyl benzene sulfonic acids, cetyl phenyl sulfonic acids, and the like, aliphatic sulfonic acid, such as paraffin wax sulfonic acids, hydroxy-substituted paraffin wax sulfonic acids, etc., cycloaliphatic sulfonic acids, petroleum naphthalene sulfonic acids, cetyl cyclopentyl sulfonic acid, mono- and poly-wax-substituted cyclohexyl sulfonic acids, and the like. The term "petroleum sulfonic acids" is intended to cover all natural sulfonic acids that are derived directly from petroleum products. Typical Group II metal sulfonates suitable for use in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc.

Also preferred are synthetic alkyl aryl sulfonates. Particularly useful are synthetic alkyl aryl sulfonates having the aryl sulfonate attached at the 1 or 2 position of the alkyl group, preferably greater than 5 mole %, more preferably greater than 13 mole % and more preferably greater than 20 mole %, as these have shown good compatibility and solubility while not forming a skin at these levels of overbasing. Preferred are linear monoalkyl sulfonates. Preferably the alkyl chain contains between 14 and 40 carbons and more preferably the alkyl aryl sulfonate is derived from a $C_{14}$-$C_{40}$ normal alpha olefin and more particularly from a $C_{20}$-$C_{28}$ or a $C_{20}$-$C_{24}$ normal alpha olefin.

Mixtures of high TBN sulfonates can be employed including mixtures of natural sulfonates and synthetic sulfonates, mixtures of synthetic sulfonates such as mixtures of monoalkyl and dialkyl sulfonates, mixtures of monoalkyl and polyalkyl sulfonates or mixtures of dialkyl and polyalkyl sulfonates.

The overbased alkaline earth metal alkyl aryl sulfonate detergent will generally have a TBN from about 25 to 500, preferably 250 to 500, and more preferably 300 to 450.

The overbased alkaline earth metal alkyl aryl sulfonate detergent comprises from about 0.1 to 10 wt % and preferably 0.5 to 3.0 wt %, based on the total weight of the lubricating oil composition.

Oxymolybdenum-Containing Complex

The unsulfurized or sulfurized oxymolybdenum-containing composition employed in the present invention may be generally characterized as a oxymolybdenum complex of a basic nitrogen compound. Such molybdenum/sulfur complexes are known in the art and are described, for example, in U.S. Pat. No. 4,263,152 to King et al., the disclosure of which is hereby incorporated by reference.

The structure of the molybdenum compositions employed in this invention are not known with certainty; however, they are believed to be compounds in which molybdenum, whose valences are satisfied with atoms of oxygen or sulfur, is either complexed by, or the salt of, one or more nitrogen atoms of the basic nitrogen containing compound used in the preparation of these compositions.

The molybdenum compounds used to prepare the oxymolybdenum and oxymolybdenum/sulfur complexes employed in the present invention are acidic molybdenum compounds. By acidic is meant that the molybdenum compounds will react with a basic nitrogen compound as measured by ASTM test D-664 or D-2896 titration procedure. Typically these molybdenum compounds are hexavalent and are represented by the following compositions: molybdic acid, ammonium molybdate, sodium molybdate, potassium molybdate and other alkaline metal molybdates and other molybdenum salts such as hydrogen salts, e.g., hydrogen sodium molybdate, $MoOCl_4$, $MoO_2Br_2$, $Mo_2O_3Cl_6$, molybdenum trioxide or similar acidic molybdenum compounds. Preferred acidic molybdenum compounds are molybdic acid, ammonium molybdate, and alkali metal molybdates. Particularly preferred are molybdic acid and ammonium molybdate.

The basic nitrogen compound used to prepare the oxymolybdenum complexes have at least one basic nitrogen and are preferably oil-soluble. Typical examples of such compositions are succinimides, carboxylic acid amides, hydrocarbyl monoamines, hydrocarbon polyamines, Mannich bases, phosphoramides, thiophosphoramides, phosphonamides, dispersant viscosity index improvers, and mixtures thereof. Any of the nitrogen-containing compositions may be after-treated with, e.g., boron, using procedures well known in the art so long as the compositions continue to contain basic nitrogen. These after-treatments are particularly applicable to succinimides and Mannich base compositions.

The mono and polysuccinimides that can be used to prepare the molybdenum complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound. Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1500 and 50000 average molecular weight. A typical compound would be that prepared by reacting polyisobutenyl succinic anhydride and ethylene dipiperazine.

Carboxylic acid amide compositions are also suitable starting materials for preparing the oxymolybdenum complexes employed in this invention. Typical of such compounds are those disclosed in U.S. Pat. No. 3,405,064, the disclosure of which is hereby incorporated by reference. These compositions are ordinarily prepared by reacting a carboxylic acid or anhydride or ester thereof, having at least 12 to about 350 aliphatic carbon atoms in the principal aliphatic chain and, if desired, having sufficient pendant aliphatic groups to render the molecule oil soluble with an amine or a hydrocarbyl polyamine, such as an ethylene amine, to give a mono or polycarboxylic acid amide. Preferred are those amides prepared from (1) a carboxylic acid of the formula R'COOH, where R' is $C_{12-20}$ alkyl or a mixture of this acid with a polyisobutenyl carboxylic acid in which the polyisobutenyl group contains from about 72 to 128 carbon atoms and (2) an ethylene amine, especially triethylene tetramine or tetraethylene pentamine or mixtures thereof.

Another class of compounds which are useful in this invention are hydrocarbyl monoamines and hydrocarbyl polyamines, preferably of the type disclosed in U.S. Pat. No. 3,574,576, the disclosure of which is hereby incorporated by reference. The hydrocarbyl group, which is preferably alkyl, or olefinic having one or two sites of unsaturation, usually contains from about 9 to 350, preferably from about 20 to 200 carbon atoms. Particularly preferred hydrocarbyl polyamines are those which are derived, e.g., by reacting polyisobutenyl chloride and a polyalkylene polyamine, such as an ethylene amine, e.g., ethylene diamine, diethylene triamine, tetraethylene pentamine, 2-aminoethylpiperazine, 1,3-propylene diamine, 1,2-propylenediamine, and the like.

Another class of compounds useful for supplying basic nitrogen are the Mannich base compositions. These compositions are prepared from a phenol or $C_{9-200}$ alkylphenol, an aldehyde, such as formaldehyde or formaldehyde precursor such as paraformaldehyde, and an amine compound. The amine may be a mono or polyamine and typical compositions are prepared from an alkylamine, such as methylamine or an ethylene amine, such as, diethylene triamine, or tetraethylene pentamine, and the like. The phenolic material may be sulfurized and preferably is dodecylphenol or a $C_{80-100}$ alkylphenol. Typical Mannich bases which can be used in this invention are disclosed in U.S. Pat. Nos. 4,157,309 and 3,649,229; 3,368,972; and 3,539,663, the disclosures of which are hereby incorporated by reference. The last referenced patent discloses Mannich bases prepared by reacting an alkylphenol having at least 50 carbon atoms, preferably 50 to 200 carbon atoms with formaldehyde and an alkylene polyamine $HN(ANH)_nH$ where A is a saturated divalent alkyl hydrocarbon of from about 2 to 6 carbon atoms and n is from about 1-10 and where the condensation product of said alkylene polyamine may be further reacted with urea or thiourea. The utility of these Mannich bases as starting materials for preparing lubricating oil additives can often be significantly improved by treating the Mannich base using conventional techniques to introduce boron into the composition.

Another class of composition useful for preparing the oxymolybdenum complexes employed in this invention are the phosphoramides and phosphonamides such as those disclosed in U.S. Pat. Nos. 3,909,430 and 3,968,157, the disclosures of which are hereby incorporated by reference. These compositions may be prepared by forming a phosphorus compound having at least one P—N bond. They can be prepared, for example, by reacting phosphorus oxychloride with a hydrocarbyl diol in the presence of a monoamine or by reacting phosphorus oxychloride with a difunctional secondary amine and a mono-functional amine. Thiophosphoramides can be prepared by reacting an unsaturated hydrocarbon compound containing from about 2 to 450 or more carbon atoms, such as polyethylene, polyisobutylene, polypropylene, ethylene, 1-hexene, 1,3-hexadiene, isobutylene, 4-methyl-1-pentene, and the like, with phosphorus pentasulfide and a nitrogen-containing compound as defined above, particularly an alkylamine, alkyldiamine, alkylpolyamine, or an alkyleneamine, such as ethylene diamine, diethylenetriamine, triethylenetetramine, tetraethylenepentamine, and the like.

Another class of nitrogen-containing compositions useful in preparing the molybdenum complexes employed in this invention includes the so-called dispersant viscosity index improvers (VI improvers). These VI improvers are commonly prepared by functionalizing a hydrocarbon polymer, especially a polymer derived from ethylene and/or propylene, optionally containing additional units derived from one or more co-monomers such as alicyclic or aliphatic olefins or diolefins. The functionalization may be carried out by a variety of processes which introduce a reactive site or sites which usually has at least one oxygen atom on the polymer. The polymer is then contacted with a nitrogen-containing source to introduce nitrogen-containing functional groups on the polymer backbone. Commonly used nitrogen sources include any basic nitrogen compound especially those nitrogen-containing compounds and compositions described herein. Preferred nitrogen sources are alkylene amines, such as ethylene amines, alkyl amines, and Mannich bases.

Preferred basic nitrogen compounds for use in this invention are succinimides, carboxylic acid amides, and Mannich bases. More preferred are succinimides having an average molecular weight of 1000 or 1300 or 2300 and mixtures thereof. Such succinimides can be post treated with boron or ethylene carbonate as known in the art.

The oxymolybdenum complexes of this invention can also be sulfurized. Representative sulfur sources for preparing the oxymolybdenum/sulfur complexes used in this invention are sulfur, hydrogen sulfide, sulfur monochloride, sulfur dichloride, phosphorus pentasulfide, $R''_2$-$S_x$ where R" is hydrocarbyl, preferably $C_{1-40}$ alkyl, and x is at least 2, inorganic sulfides and polysulfides such as $(NH_4)_2S_y$, where y is at least 1, thioacetamide, thiourea, and mercaptans of the formula R"SH where R" is as defined above. Also useful as sulfurizing agents are traditional sulfur-containing antioxidants such as wax sulfides and polysulfides, sulfurized olefins, sulfurized carboxylic and esters and sulfurized ester-olefins, and sulfurized alkylphenols and the metal salts thereof.

The sulfurized fatty acid esters are prepared by reacting sulfur, sulfur monochloride, and/or sulfur dichloride with an unsaturated fatty ester under elevated temperatures. Typical esters include $C_1$-$C_{20}$ alkyl esters of $C_8$-$C_{24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, caster oil, peanut oil, rape oil, fish oil, sperm oil, and so forth.

Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10}$-$C_{25}$ olefins with fatty acid esters of $C_{10}$-$C_{25}$ fatty acids and $C_{10}$-$C_{25}$ alkyl or alkenyl alcohols, wherein the fatty acid and/or the alcohol is unsaturated may also be used.

Sulfurized olefins are prepared by the reaction of the $C_3$-$C_6$ olefin or a low-molecular-weight polyolefin derived therefrom with a sulfur-containing compound such as sulfur, sulfur monochloride, and/or sulfur dichloride.

Also useful are the aromatic and alkyl sulfides, such as dibenzyl sulfide, dixylyl sulfide, dicetyl sulfide, diparaffin wax sulfide and polysulfide, cracked wax-olefin sulfides and so forth. They can be prepared by treating the starting material, e.g., olefinically unsaturated compounds, with sulfur, sulfur monochloride, and sulfur dichloride. Particularly preferred are the paraffin wax thiomers described in U.S. Pat. No. 2,346,156.

Sulfurized alkyl phenols and the metal salts thereof include compositions such as sulfurized dodecylphenol and the calcium salts thereof. The alkyl group ordinarily contains from about 9 to 300 carbon atoms. The metal salt may be preferably, a Group I or Group II salt, especially sodium, calcium, magnesium, or barium.

Preferred sulfur sources are sulfur, hydrogen sulfide, phosphorus pentasulfide, $R'''_2S_z$ where R''' is hydrocarbyl, preferably $C_1$-$C_{10}$ alkyl, and z is at least 3, mercaptans wherein R''' is $C_1$-$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

The polar promoter used in the preparation of the molybdenum complexes employed in this invention is one which facilitates the interaction between the acidic molybdenum compound and the basic nitrogen compound. A wide variety of such promoters are well known to those skilled in the art. Typical promoters are 1,3-propanediol, 1,4-butane-diol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran and water. Preferred are water and ethylene glycol. Particularly preferred is water.

While ordinarily the polar promoter is separately added to the reaction mixture, it may also be present, particularly in the case of water, as a component of non-anhydrous starting materials or as waters of hydration in the acidic molybdenum compound, such as $(NH_4)_6Mo_7O_{24}.H_2O$. Water may also be added as ammonium hydroxide.

A method for preparing the oxymolybdenum complexes used in this invention is to prepare a solution of the acidic molybdenum precursor and a polar promoter with a basic nitrogen-containing compound with or without diluent. The diluent is used, if necessary, to provide a suitable viscosity for easy stirring. Typical diluents are lubricating oil and liquid compounds containing only carbon and hydrogen. If desired, ammonium hydroxide may also be added to the reaction mixture to provide a solution of ammonium molybdate. This reaction is carried out at a variety of temperatures, typically at or below the melting point of the mixture to reflux temperature. It is ordinarily carried out at atmospheric pressure although higher or lower pressures may be used if desired. This reaction mixture may optionally be treated with a sulfur source as defined above at a suitable pressure and temperature for the sulfur source to react with the acidic molybdenum and basic nitrogen compounds. In some cases, removal of water from the reaction mixture may be desirable prior to completion of reaction with the sulfur source.

In a preferred and improved method for preparing the oxymolybdenum complexes, the reactor is agitated and heated at a temperature less than or equal to about 120° C., preferably from about 70° C. to about 90° C. Molybdic oxide or other suitable molybdenum source is then charged to the reactor and the temperature is maintained at a temperature less than or equal to about 120° C., preferably at about 70° C. to about 90° C., until the molybdenum is sufficiently reacted. Excess water is removed from the reaction mixture. Removal methods include but are not limited to vacuum distillation or nitrogen stripping while maintaining the temperature of the reactor at a temperature less than or equal to about 120° C., preferably between about 70° C. to about 90° C. The temperature during the stripping process is held at a temperature less than or equal to about 120° C. to maintain the low color intensity of the molybdenum-containing composition. It is ordinarily carried out at atmospheric pressure although higher or lower pressures may be used. The stripping step is typically carried out for a period of about 0.5 to about 5 hours.

If desired, this product can be sulfurized by treating this reaction mixture with a sulfur source as defined above at a suitable pressure and temperature, not to exceed about 120° C. for the sulfur source to react with the acidic molybdenum and basic nitrogen compounds. The sulfurization step is typically carried out for a period of from about 0.5 to about 5 hours and preferably from about 0.5 to about 2 hours. In some cases, removal of the polar promoter (water) from the reaction mixture may be desirable prior to completion of reaction with the sulfur source. The oxymolybdenum complex and oxymolybdenum/sulfur complex produced by such method is lighter in color (when compared to complexes prepared at higher temperatures) while maintaining good fuel economy, excellent oxidation inhibition, and anti-wear performance qualities. Color in this instance can be more visibly or more quantifiably using a UV spectrophotometer such as a Perkin-Elmer Lambda 18 UV-Visible Double-Beam Spectrophotometer. As used herein, this test recorded the visible spectra of molybdenum compositions at a constant concentration in an isooctane solvent. The spectra represent the absorbance intensity plotted versus the wavelength in nanometers. The spectra extend from the visible region into the near infrared region of the electromagnetic radiation (350 nanometers to 900 nanometers). In this test, the highly colored samples showed increasingly higher absorbance at increasingly higher wavelengths at a constant molybdenum concentration. The preparation of the sample for color measurement comprises diluting the molybdenum-containing composition with isooctane to achieve a constant molybdenum concentration of 0.00025 g molybdenum per gram of the molybdenum-containing composition/isooctane mixture.

Prior to sample measurement the spectrophotometer is referenced by scanning air versus air. The UV visible spectrum from 350 nanometers to 900 nanometers is obtained using a one centimeter path-length quartz cell versus an air reference. The spectra are offset corrected by setting the 867 nanometer absorbance to zero. Then the absorbance of the sample is determined at 350 nanometers wavelength.

Characteristics of these new oxymolybdenum/sulfur complexes are disclosed in U.S. patent application Ser. No. 10/159,446 filed May 31, 2002, entitled REDUCED COLOR MOLYBDENUM-CONTAINING COMPITION AND A METHOD OF MAKING SAME, incorporated herein by reference in its entirety.

In the reaction mixture, the ratio of molybdenum compound to basic nitrogen compound is not critical; however, as the amount of molybdenum with respect to basic nitrogen increases, the filtration of the product becomes more difficult. Since the molybdenum component probably oligomerizes, it is advantageous to add as much molybdenum as can easily be maintained in the composition. Usually, the reaction mixture will have charged to it from about 0.01 to 2.00 atoms of molybdenum per basic nitrogen atom. Preferably from about 0.3 to 1.0, and most preferably from about 0.4 to 0.7, atoms of molybdenum per atom of basic nitrogen is added to the reaction mixture.

When optionally sulfurized, the sulfurized oxymolybdenum containing compositions may be generally characterized as a sulfur/molybdenum complex of a basic nitrogen dispersant compound preferably with a sulfur to molybdenum weight ratio of from about (0.01 to 1.0) to 1 and more preferably from about (0.05 to 0.5) to 1 and a nitrogen to molybdenum weight ratio of from about (1 to 10) to 1 and more preferably from about (2 to 5) to 1. For extremely low sulfur incorporation the sulfur to molybdenum weight ratio can be from about (0.01 to 0.08) to 1.

The oxymolybdenum-containing complex comprises from about 0.02 to 10 wt % and preferably from about 0.1 to 2.0 wt %, based on the total weight of the lubricating oil composition.

Friction Modifier

Friction modifiers include such compounds as aliphatic carboxylic acids, aliphatic carboxylic esters of polyols such as glycerol esters of fatty acid as exemplified by glycerol oleate, boric esters of glycerol fatty acid monoesters, aliphatic phosphonates, aliphatic phosphates, aliphatic thiophosphonates, aliphatic thiophosphates, etc., wherein the aliphatic group usually contains above about eight carbon atoms so as to render the compound suitably oil soluble.

Representative examples of suitable friction modifiers are found in U.S. Pat. No. 3,933,659 which discloses fatty acid esters; U.S. Pat. No. 4,105,571 which discloses glycerol esters of dimerized fatty acids; U.S. Pat. No. 4,702,859 which discloses esters of carboxylic acids and anhydrides with alkanols; U.S. Pat. Nos. 4,530,771 and 5,629,272 which is a preferred borated glycerol monooleate comprising esters constituted with a glycerol, fatty acid and a boric acid, said ester having a positive amount up to 2.0 moles of a carboxylic acid residue comprising a saturated or unsaturated alkyl group having from about 8 to 24 carbon atoms and from about 1.5 to 2.0 moles of a glycerol residue, both per unit mole of a boric acid residue on average of the boric esters used singly or in combination, molar proportion between said carboxylic acid residue and said glycerol residue being that the glycerol residue is 1.2 moles or more based on 1 mole of the carboxylic acid residue; U.S. Pat. No. 3,779,928 which discloses alkane phosphonic acid salts, the disclosure which is herein incorporated by reference.

In a preferred embodiment, the friction modifier employed in the lubricating oil composition of the present invention is an ester of a carboxylic acid and a polyhydric alcohol such as those disclosed in U.S. Pat. No. 6,203,584, which is hereby incorporated by reference for all purposes. The ester component employed in the present fuel composition is an ester of a carboxylic acid and a polyhydric alcohol, wherein the carboxylic acid has from one to about four carboxylic acid groups and from about 8 to about 50 carbon atoms and the polyhydric alcohol has from about 2 to about 50 carbon atoms and from about 2 to about 6 hydroxy groups.

The carboxylic acid employed in the preparation of the ester compound will generally be an aliphatic saturated or unsaturated, straight chain or branched chain, mono- or polycarboxylic acid having from about 1 to about 4 carboxylic acid groups and from about 8 to about 50 carbon atoms.

When the carboxylic acid is a monocarboxylic acid, it will preferably contain from about 8 to about 30 carbon atoms, more preferably from about 10 to about 28 carbon atoms, and most preferably from about 10 to about 22 carbon atoms.

Examples of saturated monocarboxylic acids include those having from about 10 to about 22 carbon atoms, such as capric, lauric, myristic, palmitic, stearic and behenic acid. Examples of unsaturated monocarboxylic acids include those having from about 10 to about 22 carbon atoms, such as oleic, elaidic, palmitoleic, petroselic, eleostearic, linoleic, linolenic, erucic and hypogaeic acid.

When the carboxylic acid is a polycarboxylic acid, it generally will be an aliphatic saturated or unsaturated polycarboxylic acid having from about 2 to about 4, preferably from about 2 to about 3, and more preferably from about 2 carboxylic acid groups. An example of a suitable dicarboxylic acid is dodecenyl succinic acid.

Preferably, the carboxylic acid is oleic acid.

The alcohol used in the preparation of the ester compound is generally an aliphatic, saturated or unsaturated, straight chain or branched chain polyhydric alcohol having from about 2 to about 6 hydroxy groups and from about 2 to about 50 carbon atoms, preferably, from about 2 to about 30 carbon atoms, and more preferably, from about 2 to about 12 carbon atoms.

Suitable polyhydric alcohols include dihydroxy alcohols, such as the alkylene glycols, for example, ethylene glycol and propylene glycol, trihydroxy alcohols, such as glycerol, tetrahydroxy alcohols, such as pentaerythritol, and hexahydroxy alcohols, such as sorbitol.

The carboxylic acid and polyhydric alcohol are reacted under typical esterification conditions well known in the art to provide the esters employed in the present invention.

Examples of esters of polyhydric alcohols that may be used are those where all of the hydroxy groups are esterified, as well as those where not all of the hydroxy groups are esterified. Specific examples are esters prepared from trihydric alcohols and one or more of the above-mentioned saturated or unsaturated carboxylic acids, such as glycerol monoesters and glycerol diesters, e.g. glycerol monooleate, glycerol dioleate and glycerol monostearate. Such polyhydric esters may be prepared by esterification as described in the art and/or may be commercially available.

The ester may have one or more free hydroxy groups.

Preferred esters which are suitable for use in the present invention include glycerol monooleate, pentaerythritol monooleate and sorbitan monooleate, particularly glycerol monooleate and pentaerythritol monooleate.

Boric acid derivatives of the ester of the carboxylic acid and polyhydric alcohol are particularly useful in the lubricating oil composition of the present invention. Suitable boric acid esters are disclosed in U.S. Pat. Nos. 4,530,771 and 5,629,272, cited above, which is hereby incorporated in its entirety by reference for all purposes.

Most preferably, the friction modifier employed in the lubricating oil of the present invention is borated glycerol monooleate.

The friction modifier is incorporated in the lubricating oil composition of the present invention in an amount of from about 0.1 to 5 wt. %, based on the total weight of the lubricating oil composition. Preferably, from about 0.2 to 1.5 wt %, based on the total weight of the lubricating oil composition, of the friction modifier may be used.

Antioxidant

An oxidation inhibitor or antioxidant is employed in the lubricating oil composition of the present invention. Antioxidants reduce the tendency of base stocks to deteriorate in service, which deterioration can be evidenced by the products of oxidation such as sludge and varnish-like deposits on the metal surfaces and by viscosity growth.

Preferably, the antioxidant employed in the lubricating oil composition is selected from the group consisting of a diphenylamine type, a sulfur-containing compound and mixtures thereof.

Diphenylamine type antioxidant employable in the present invention may be selected form the group consisting of alkylated diphenylamine, phenyl-α-naphthylamine, and alkylated-α-naphthylamine. Preferably, the diphenylamine type antioxidant is an alkylated diphenylamine.

Alternatively the antioxidant employed in the lubricating oil of the present invention may also be a sulfur-containing compound such as, but is not limited to, alkaline earth metal salts of alkylphenolthioesters having preferably $C_5$ to $C_{12}$ alkyl side chains, calcium nonylphenol sulfides, ashless oil-soluble phenates and sulfurized phenates, phosphosulfurized or sulfurized hydrocarbons, wax sulfides and polysulfides, sulfurized olefins, sulfurized carboxylic acids and esters, sulfurized ester-olefins, sulfurized alkylphenols, phosphorus esters, metal thiocarbamates or dithiocarbamates wherein the metal is zinc, copper or molybdenum, ashless thiocarbamates or dithiocarbamates (i.e., essentially metal free) such as methylenebis(dialkyldithiocarbamate), ethylenebis(dialkyldithiocarbamate), and isobutyl disulfide-2,2'-bis(dialkyldithiocarbamate) where the alkyl groups of the dialkyldithiocarbamate can preferably have form 1 to 6 carbon atoms. Examples of preferred ashless dithiocarbamates are methylenebis(dibutyidithiocarbamate), ethylenebis(dibutylthiocarbamate) and isobutyl disulfide-2,2'-bis(dibutyldithiocarbamate). Preferably, the sulfur-containing antioxidant is a thiocarbamate or dithiocarbamate. More preferably, the sulfur-containing antioxidant is a dithiocarbamate.

The oxidation inhibitors may be use singly or in combination with each other or in combination with other types of oxidation inhibitors.

The antioxidant comprises from about 0.2 to 10 wt % and preferably 0.5 to 2.5 wt %, based on the total weight of the lubricating oil composition.

The lubricating oil composition of the present invention is notably effective at reducing deposits when the total concentration of the oxymolybdenum-containing complex and the antioxidant is at least 1.3 wt %, preferably at least 1.45 wt %, based on the total weight of the lubricating oil composition.

Oil Soluble, Phosphorus-Containing, Anti-Wear Compound

The lubricating oil composition of the present invention may also contain an oil-soluble, phosphorus-containing, antwear compound. Preferably a minor amount of antiwear agent, a metal dihydrocarbyl dithiophosphate is added to the lubricant composition. The metal is preferably zinc. The dihydrocarbyldithiophosphate may be present in amount of from about 0.1 to 2 wt % but typically low phosphorus compositions are desired so the dihydrocarbyldithiophosphate is employed at from about 0.25 to 1.2 wt %, preferably from about 0.5 to 0.7 wt %, in the lubricating oil composition. Preferably, zinc dialkylthiophosphate (ZDDP) is used. This provides antioxidant and antiwear properties to the lubricating composition. Such compounds may be prepared in accordance with known techniques by first forming a dithiophosphoric acid, usually by reaction of an alcohol or a phenol with $P_2S_5$ and then neutralizing the dithiophosphoric acid with a suitable zinc compound. Mixtures of alcohols may be used including mixtures of primary and secondary alcohols. Examples of such alcohols include, but are not restricted to the following list: iso-propanol, iso-octanol, 2-butanol, methyl isobutyl carbinol (4-methyl-1-pentane-2-ol), 1-pentanol, 2-methyl butanol, and 2-methyl-1-propanol. The hydrocarbyl groups can be a primary, secondary, or mixtures thereof, e.g. the compounds may contains primary and/or secondary alkyl groups derived from primary or secondary carbon atoms. Moreover, when employed, there is preferably at least 50, more preferably 75 or more, most preferably from about 85 to 100, mass % secondary alkyl groups; an example is a ZDDP having 85 mass % secondary alkyl groups and 15 mass % primary alkyl groups, such as a ZDDP made from 85 mass % butan-2-ol and 15 mass % iso-octanol. Even more preferred is a ZDDP derived from derived from sec-butanol and methylisobutylcarbinol and most preferably wherein the sec-butanol is 75 mole percent.

The metal dihydrocarbyldithiophosphate provides most if not all, of the phosphorus content of the lubricating oil composition. Amounts are present in the lubricating oil composition to provide a phosphorus content, expressed as mass % elemental phosphorus, of 0.08 or less, preferably 0.06 or less, and more preferably 0.05.

The oil-soluble, phosphorus-containing, anti-wear compound comprises from about 0.1 to 2.0 wt % and preferably 0.25 to 1.2 wt %, based on the total weight of the lubricating oil composition.

Dispersant

A dispersant may also be employed in the lubricating oil composition of the present invention. The dispersant may be ashless dispersants such as an alkenyl succinimide, an alkenyl succinic anhydride, an alkenyl succinate ester, and the like, or mixtures of such dispersants.

Ashless dispersants are broadly divided into several groups. One such group is directed to copolymers which contain a carboxylate ester with one or more additional polar function, including amine, amide, imine, imide, hydroxyl carboxyl, and the like. These products can be prepared by copolymerization of long chain alkyl acrylates or methacrylates with monomers of the above function. Such groups include alkyl methacrylate-vinyl pyrrolidinone copolymers, alkyl methacrylate-dialkylaminoethyl methacrylate copolymers and the like. Additionally, high molecular weight amides and polyamides or esters and polyesters such as tetraethylene pentamine, polyvinyl polysterarates and other polystearamides may be employed. Preferred dispersants are N-substituted long chain alkenyl succinimides.

Mono and bis alkenyl succinimides are usually derived from the reaction of alkenyl succinic acid or anhydride and alkylene polyamines. These compounds are generally considered to have the formula

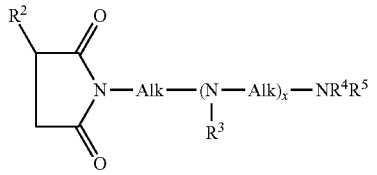

wherein $R^2$ is a substantially hydrocarbon radical having a molecular weight from about 450 to 3000, that is, $R^2$ is a hydrocarbyl radical, preferably an alkenyl radical, containing from about 30 to about 200 carbon atoms; Alk is an alkylene radical of from about 2 to 10, preferably from about 2 to 6, carbon atoms, $R^3$, $R^4$, and $R^5$ are selected from a $C_1$-$C_4$ alkyl or alkoxy or hydrogen, preferably hydrogen, and x is an integer from about 0 to 10, preferably from about 0 to 3. The actual reaction product of alkylene or alkenylene succinic acid or anhydride and alkylene polyamine will comprise the mixture of compounds including succinamic acids and succinimides. However, it is customary to designate this reaction product as a succinimide of the described formula, since this will be a principal component of the mixture. The mono alkenyl succinimide and bis alkenyl succinimide produced may depend on the charge mole ratio of polyamine to succinic groups and the particular polyamine used. Charge mole ratios of polyamine to succinic groups of about 1:1 may produce predominately mono alkenyl succinimide. Charge mole ratios of polyamine to succinic group of about 1:2 may produce predominately bis alkenyl succinimide.

These N-substituted alkenyl succinimides can be prepared by reacting maleic anhydride with an olefinic hydrocarbon followed by reacting the resulting alkenyl succinic anhydride with the alkylene polyamine. The $R^2$ radical of the above formula, that is, the alkenyl radical, is preferably derived from a polymer prepared from an olefin monomer containing from about 2 to 5 carbon atoms. Thus, the alkenyl radical is obtained by polymerizing an olefin containing from about 2 to 5 carbon atoms to form a hydrocarbon having a molecular weight ranging from about 450 to 3000. Such olefin monomers are exemplified by ethylene, propylene, 1-butene, 2-butene, isobutene, and mixtures thereof.

In a preferred aspect, the alkenyl succinimide may be prepared by reacting a polyalkylene succinic anhydride with an alkylene polyamine. The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents are incorporated herein by reference in their entirety. The polyalkylene succinic anhydride is preferably a polyisobutenyl succinic anhydride. In one preferred embodiment, the polyalkylene succinic anhydride is a polyisobutenyl succinic anhydride having a number average molecular weight of at least 450, more preferably at least from about 900 to 3000 and still more preferably from at least from about 900 to 2300.

In another preferred embodiment, a mixture of polyalkylene succinic anhydrides is employed. In this embodiment, the mixture preferably comprises a low molecular weight polyalkylene succinic anhydride component and a high molecular weight polyalkylene succinic anhydride component. More preferably, the low molecular weight component has a number average molecular weight of from about 450 to below 1000 and the high molecular weight component has a number average molecular weight of from about 1000 to about 3000. Still more preferably, both the low and high molecular weight components are polyisobutenyl succinic anhydrides. Alternatively, various molecular weights polyalkylene succinic anhydride components can be combined as a dispersant as well as a mixture of the other above referenced dispersants as identified above.

The polyalkylene succinic anhydride can also be incorporated with the detergent which is anticipated to improve stability and compatibility of the detergent mixture. When employed with the detergent it can comprise from about 0.5 to 5.0 percent by weight of the detergent mixture and preferably from about 1.5 to 4.0 wt %.

The preferred polyalkylene amines used to prepare the succinimides are of the formula:

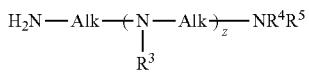

wherein z is an integer of from about 0 to 10 and Alk, $R^3$, $R^4$, and $R^5$ are as defined above.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl)imidazoline, 1-(2-aminopropyl)-piperazine, 1,4-bis(2-aminoethyl) piperazine and 2-methyl-1-(2-aminobutyl)piperazine.

Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898-905 (Interscience Publishers, New York, 1950).

The term "ethylene amine" is used in a generic sense to denote a class of polyamines conforming for the most part to the structure $$H_2N(CH_2CH_2NH)_aH$$

wherein a is an integer from 1 to 10.

Thus, it includes, for example, ethylene diamine, diethylene triamine, triethylene tetraamine, tetraethylene pentamine, pentaethylene hexamine, and the like.

The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Also included within the term "alkenyl succinimides" are post-treated succinimides such as post-treatment processes involving borate or ethylene carbonate disclosed by Wollenberg, et al., U.S. Pat. No. 4,612,132, Wollenberg, et al., U.S. Pat. No. 4,746,446; and the like as well as other post-treatment processes each of which are incorporated herein by reference in its entirety. Preferably, the carbonate-treated alkenyl succinimide is a polybutene succinimide derived from polybutenes having a molecular weight of from about 450 to 3000, preferably from about 900 to 2500, more preferably from about 1300 to 2300, and preferably from about 2000 to 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912 incorporated herein by reference.

The dispersant when employed in the lubricating oil composition of the present invention comprises from about 2.0 to 10 wt %, preferably 3.0 to 5.0 wt %, based on the total weight of the lubricating oil composition.

Base Oil of Lubricating Viscosity

The lubricating oil composition of the present invention includes a major amount of base oil of lubricating viscosity. Base oil as used herein is defined as a base stock or blend of base stocks which is a lubricant component that is produced by a single manufacturer to the same specifications (independent of feed source or manufacturer's location); that meets the same manufacturer's specification; and that is identified by a unique formula, product identification number, or both. Base stocks may be manufactured using a variety of different processes including but not limited to distillation, solvent refining, hydrogen processing, oligomerization, esterification, and rerefining. Rerefined stock shall be substantially free from materials introduced through manufacturing, contamination, or previous use. The base oil of this invention may be any natural or synthetic lubricating base oil fraction particularly those having a kinematic viscosity at 100 degrees Centigrade (C) and about 4 centistokes (cSt) to about 20 cSt. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. A preferred base oil is one that comprises little, if any, heavy fraction; e.g., little, if any, lube oil fraction of viscosity about 20 cSt or higher at about 100 degrees C. Oils used as the base oil will be selected or blended depending on the desired end use and the additives in the finished oil to give the desired grade of engine oil, e.g. a lubricating oil composition having an SAE Viscosity Grade of 0W, 0W-20, 0W-30, 0W40, 0W-50, 0W-60, 5W, 5W-20, 5W-30, 5W40, 5W-50, 5W-60, 10W, 10W-20, 10W-30, 10W40, 10W-50, 15W, 15W-20, 15W-30, or 15W40.

The base oil may be derived from natural lubricating oils, synthetic lubricating oils or mixtures thereof. Suitable base oil includes base stocks obtained by isomerization of synthetic wax and slack wax, as well as hydrocrackate base stocks produced by hydrocracking (rather than solvent extracting) the aromatic and polar components of the crude. Suitable base oils include those in all API categories I, II, III, IV and V as defined in API Publication 1509, 14th Edition, Addendum I, December 1998, which is herein incorporated for all purposes. Saturates levels and viscosity indices for Group I, II and III base oils are listed in Table 1. Group IV base oils are polyalphaolefins (PAO). Group V base oils include all other base oils not included in Group I, II, III, or IV. Group II, III and IV base oils are also useful in the present invention. Group II and III base oils may be prepared by combining one or more of Group I, II, and III base stocks or base oils.

TABLE 1

SATURATES, SULFUR AND VISCOSITY INDEX OF GROUP I, II AND III BASE STOCKS

| Group | Saturates (As determined by ASTM D 2007) Sulfur (As determined by ASTM D 2270) | Viscosity Index (As determined by ASTM D 4294, ASTM D 4297 or ASTM D 3120) |
|---|---|---|
| I | Less than 90% saturates and/or Greater than to 0.03% sulfur | Greater than or equal to 80 and less than 120 |
| II | Greater than or equal to 90% saturates and less than or equal to 0.03% sulfur | Greater than or equal to 80 and less than 120 |
| III | Greater than or equal to 90% saturates and less than or equal to 0.03% sulfur | Greater than or equal to 120 |
| IV | All Polyalphaolefins (PAOs) | |
| V | All others not included in Groups I, II, III, or IV | |

Natural lubricating oils may include animal oils, vegetable oils (e.g., rapeseed oils, castor oils and lard oil), petroleum oils, mineral oils, and oils derived from coal or shale.

Synthetic oils may include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogues and homologues thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Tri-alkyl phosphate ester oils such as those exemplified by tri-n-butyl phosphate and tri-iso-butyl phosphate are also suitable for use as base oils.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The base oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which may then be used without further treatment. Refined oils are similar to the unrefined oils except that refined oils have been treated in one or more purification steps to improve one or more properties. Suitable purification techniques include distillation, hydrocracking, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

It is preferred to use a major amount of base oil of lubricating viscosity in the lubricating oil composition of the present invention. A major amount of base oil of lubricating viscosity as defined herein comprises 40 wt % or more, preferably about 40 wt % to about 97 wt %, more preferably about 50 wt % to about 97 wt %, still more preferably about 60 wt % to about 97 wt % and most preferably about 80 wt % to about 95 wt % of the lubricating oil composition.

Other Additives

The following additive components are examples of some of the components that can be favorably employed in the present invention. These examples of additives are provided to illustrate the present invention, but they are not intended to limit it:

1. Metal detergents: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.
2. Anti-oxidants: Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methyl phenol, 2,6-di-tert-butyl-4-ethylphenol, 2,4-dimethyl-6-tert-butyl-phenol, 2,6-di-tert-I-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl).
3. Anti-wear agents: As their name implies, these agents reduce wear of moving metallic parts. Examples of such agents include, but are not limited to, phosphates, phosphites, carbamates, esters, sulfur containing compounds, and molybdenum complexes.
4. Rust inhibitors (Anti-rust agents)
   a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate.
   b) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.
5. Demulsifiers: addition product of alkylphenol and ethylene oxide, polyoxyethylene alkyl ether, and polyoxyethylene sorbitan ester.
6. Extreme pressure agents (EP agents): sulfurized oils, diphenyl sulfide, methyl trichlorostearate, chlorinated naphthalene, fluoroalkylpolysiloxane, and lead naphthenate.
7. Multifunctional additives: sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

EXAMPLES

The invention will be further illustrated by the following examples, which set forth particularly advantageous embodiments. While the Examples are provided to illustrate the present invention, they are not intended to limit it. This application is intended to cover those various changes and substitutions that may be made by those skilled in the art without departing from the spirit and scope of the appended claims.

Example 1

The low phosphorus lubricating oil compositions of the present invention were prepared by blending together the following components to obtain a SAE 5W-20 viscosity grade formulation (Table 2).

TABLE 2

| Lubricating Oil Compositions | | | |
|---|---|---|---|
| Component[a] | Oil A (Reference) | Oil B (Comparative) | Oil C (Invention) |
| Ca Sulfonate, milliMoles | 50.0 | 50.0 | 50.0 |
| Oxymolybdenum complex | 0.5 | 0.5 | 0.5 |
| Friction Modifier | 0 | 0.5 (Nitrogen-Containing) | 0.5 (Ester-Containing) |
| Diphenylamine-type Antioxidant | 0.4 | 0.4 | 0.4 |

[a]The quantity of the components in the lubricating oil are expressed as wt % unless noted otherwise. Components are:
Ca Sulfonate is high overbased (HOB) TBN 426 calcium alkyl aryl sulfonate derived from benzene and $C_{20}$-$C_{24}$ normal alpha olefin.
Oxymolybdenum complex is a sulfurized molybdenum succinimide complex, expressed as active ingredient.
Friction Modifier is:
Nitrogen-Containing: reaction product of coconut oil and diethanol amine (available from Chevron Oronite Company, LLC).
Ester-Containing: borated glycerol monooleate as disclosed in U.S. Pat. No. 5,629,272.
Diphenylamine-type Antioxidant is alkylated diphenylamine.

The balance of the lubricating oil composition contains a Group II base oil and minor other components such as foam inhibitors, viscosity index improvers, pour point depressants, dispersants, sulfur-containing antioxidants, mixture of primary and secondary zinc dialkyldithiophosphates providing less than 0.08 wt % phosphorus content, based on the total weight of oil lubricating oil composition.

The fuel economy performance was determined by engine testing using a shortened version of the Sequence VIB test entitled herein as the Sequence VIB screener. The Sequence VIB (ASTM D6837) is an engine dynamometer test that measures a lubricant's ability to improve the fuel economy of passenger cars and light-duty trucks equipped with a low friction engine. The method compares the performance of a test lubricant to the performance of a baseline lubricant over five different stages of operation. The standard Sequence VIB test incorporates a flush and run type procedure with each test consisting of two 5-stage fuel economy measurements on a baseline oil (BC), one at the beginning of the test (Phase I) and one at the end (Phase II). The test oil is evaluated in between the two baseline runs. After the test oil is initially aged during 16 hours of engine operation at 1500 r/min and 125° C. oil temperature, a phase one fuel economy for the candidate test oil is calculated. Following 80 hours at an engine speed of 2250 r/min and 135° C. oil temperature. The test oil once again goes through a 5-stage fuel economy measurement. A phase one and phase two fuels economy improvement of the candidate oil compared to the baseline oil fuel economy is calculated. In the shortened Sequence VIB screener only Phase I fuel economy is determined without severity adjustment. The calculated fuel economy improvement equates the fuel economy results obtained from vehicles representative of current production vehicles running under the current EPA (Environmental Protection Agency) testing cycles. Passing criteria, as used herein, relates to the minimum % fuel economy improvement versus the ASTM baseline (reference oil BC) for SAE 0W-20 and 5W-20 viscosity grades is at least 2.4% minimum after Phase I (16 hours aging), 2.0% minimum for SAE 0W-30 and 5W30 viscosity grades and at least 1.3% for all other SAE multiviscosity grades. The results of the VIB screener tests are presented in Table 3. Higher % FEI values indicate improved fuel economy.

TABLE 3

| VIB Screener Test Results | |
|---|---|
| Oil | % Fuel Economy Improvement (FEI) |
| A (Reference) | 1.73 |
| B (Comparative) | 2.32 |
| C (Invention) | 2.55 |

As the results indicate, the lubricating oil composition of the present invention (Oil C) gave superior improvement in fuel economy relative to the reference Oil A. The comparative Oil B also provides measurable improvement in fuel economy relative to the reference Oil A, but not in the magnitude that Oil C provided.

Example 2

The following results in Table 4 provide evidence of the further benefits of the lubricating oil composition of the present invention. The low phosphorus lubricating oil compositions were prepared by blending together the components in Table 4 to obtain a SAE 5W-30 viscosity grade formulation.

The TEOST MHT4 (Thermo-oxidation Engine Oil Simulation Test Moderately High Temperature, trademark of the Tannas Company) test is for measuring engine deposits at moderately high temperatures on a special test rod exposed to automotive engine oils. In this test, a sample of the test engine oil containing a small amount of an organo-metallic catalyst is continuously cycled to flow down the outside of a preweighed, special wire-wound depositor rod positioned in a glass-mantle casing by two metal end caps. The rod is resistively heated to obtain a constant temperature at the "hot spot" of 285° C. for 24 hours. During this time, dry air is forces to flow through the mantle chamber at a specific rate of 10 mL/min. At the end of the test, the depositor rod is carefully rinsed of oil residue using a volatile hydrocarbon solvent and any deposits flaking off the rod while being washed are caught and filtered. After drying the rod and filter, the mass of deposits on the rod and in the filter are determined. The mass of deposits on the rod plus the mass of deposits on the filter is the total rod deposit mass. The pass limit is 35 mg or less based on the ILSAC GF-4 specification.

TABLE 4

| TEOST MHT4 Test Results | | | | |
|---|---|---|---|---|
| Component | Oil D | Oil E | Oil F | Oil G |
| Ca Sulfonate, milliMoles | 45 | 45 | 45 | 45 |
| Oxymolybdenum complex | | 0.4 | | 0.4 |
| Friction Modifier | 0.3 | 0.3 | 0.3 | 0.3 |
| Diphenylamine-type Antioxidant | | — | 1.0 | 1.0 |
| TEOST MHT4 Total Deposits, mg | 92.3 | 74.8 | 51.5 | 32 |

[a]The quantity of the components in the lubricating oil are expressed as wt % unless noted otherwise. Components are:
Ca Sulfonate is high overbased TBN 426 calcium alkyl aryl sulfonate derived from benzene and $C_{20}$-$C_{24}$ normal alpha olefin.
Oxymolybdenum complex is a sulfurized molybdenum succinimide complex, expressed as active ingredient.
Friction Modifier is borated glycerol monooleate as disclosed in U.S. Pat. No. 5,629,272.
Diphenylamine-type Antioxidant is alkylated diphenylamine.

The balance of the lubricating oil composition contains a Group II base oil and minor other components such as foam inhibitors, viscosity index improvers, pour point depressants, dispersants, low overbased detergent, mixture of primary and secondary zinc dialkyldithiophosphates providing less than 0.08 wt % phosphorus content, based on the total weight of oil lubricating oil composition.

The data shows the total deposits obtained for the lubricating oil composition of the present invention (Oil G), i.e. having the combination of oxymolybdenum complex and antioxidant, was 32 mg. Comparative Oils D (no oxymolybdenum and antioxidant), Oil E (oxymolybdenum complex only) and Oil F (antioxidant only) did not pass the TEOST MHT4 test. These results demonstrate the combination of the oxymolybdenum complex and antioxidant in the lubricating oil composition of the present invention are more effective at reducing deposits than either component used singly.

Example 3

The following results in Table 5 demonstrate that using a HOB sulfonate (Oil H) versus a HOB phenate (Oil I) in the lubricating oil composition of the present invention provided superior results in the Sequence VIB screener test. The low phosphorus lubricating oil compositions were prepared by blending together the components in Table 5 to obtain a SAE 5W-20 viscosity grade formulation.

TABLE 5

HOB Sulfonate vs. HOB Phenate Sequence VIB Screener Test

| Component[a] | Oil H | Oil I |
|---|---|---|
| HOB Detergent @ 55 milliMoles | Ca Sulfonate | Ca Phenate |
| Oxymolybdenum complex | 0.5 | 0.5 |
| Friction Modifier | 0.5 | 0.5 |
| Diphenylamine-type Antioxidant | 0.4 | 0.4 |
| VIB Screener Fuel Economy, % FEI | 2.45 | 2.08 |

[a]The quantity of the components in the lubricating oil are expressed as wt % unless noted otherwise. Components are:
Ca Sulfonate is high overbased (HOB) TBN 426 calcium alkyl aryl sulfonate derived from benzene and $C_{20}$-$C_{24}$ normal alpha olefin.
Ca Phenate is 250 TBN calcium alkyl phenate as described in U.S. Pat. No. 3,178,368.
Oxymolybdenum complex is a sulfurized molybdenum succinimide complex, expressed as active ingredient.
Friction Modifier is borated glycerol monooleate as disclosed in U.S. Pat. No. 5,629,272.
Diphenylamine-type Antioxidant is alkylated diphenylamine.

The balance of the lubricating oil composition contains a Group II base oil and minor other components such as foam inhibitors, viscosity index improvers, pour point depressants, dispersants, sulfur-containing antioxidants, mixture of primary and secondary zinc dialkyldithiophosphates providing less than 0.08 wt % phosphorus content, based on the total weight of oil lubricating oil composition.

Example 4

The total concentration of the oxymolybdenum-containing complex and antioxidant must be at least 1.3 wt %, based on the total weight of the lubricating oil composition. Table 6 shows results demonstrating that a concentration of oxymolybdenum-containing complex and antioxidant of at least 1.3 wt % does not pass the ASTM Sequence IIIG/Mini Rotary Viscometer (MRV) used oil (ASTM D4684) test.

For this test, the low phosphorus lubricating oil compositions were prepared by blending together the components in Table 6 to obtain a SAE 5W-30 viscosity grade formulation.

The lubricating oil composition is first run through an ASTM Sequence IIIG Test which is a test measuring oil thickening and piston deposits under high temperature conditions and provides information about valve train wear. ASTM Sequence IIIG test is conducted with 1996/1997 231 C.I.C. (3800CC) Series II General Motors V-6 fuel-injected engine. Using unleaded gasoline, the engine runs a 10-minute initial oil leveling procedure followed by a 150-minute slow ramp up to speed and load conditions. It then operates at 125 bhp, 3600 rpm, and 150° C. oil temperature for 100 hours, interrupted at 20-hour intervals for oil level checks. After which the used oil is evaluated in the MRV test. In the MRV test the viscosity of the used oil after a 45-hour soak and cooling to test temperature is determined by measuring the yield stress. The test is used to evaluate pumpability and apparent viscosity of engine oils at low temperatures. Maximum acceptable viscosity is 60000 based on the ILSAC GF-4 specification.

TABLE 6

MRV Test Results

| Component[a] | Oil J | Oil K |
|---|---|---|
| Ca Sulfonate, milliMoles | 40.0 | 40.0 |
| Oxymolybdenum complex | 0.2 | 0.3 |
| Friction Modifier | 0.3 | 0.3 |
| Diphenylamine-type Antioxidant | 1.0 | 1.25 |
| MRV, cP 60000 max | 185500 | 42100 |

[a]The quantity of the components in the lubricating oil are expressed as wt % unless noted otherwise. Components are:
Ca Sulfonate is high overbased (HOB) TBN 426 calcium alkyl aryl sulfonate derived from benzene and $C_{20}$-$C_{24}$ normal alpha olefin.
Oxymolybdenum complex is a sulfurized molybdenum succinimide complex, expressed as active ingredient.
Friction Modifier is borated glycerol monooleate as disclosed in U.S. Pat. No. 5,629,272.
Diphenylamine-type Antioxidant is alkylated diphenylamine.

The balance of the lubricating oil composition contains a Group II base oil and minor other components such as foam inhibitors, viscosity index improvers, pour point depressants, phenates, mixture of primary and secondary zinc dialkyldithiophosphates providing less than 0.08 wt % phosphorus content, based on the total weight of oil lubricating oil composition.

As can be seen from the results presented in Table 6 above, the lubricating oil composition (Oil J) fails the MRV test when the total concentration of the oxymolybdenum-containing complex and the antioxidant is below 1.3 wt %, based on the total weight of the lubricating oil composition.

Example 5

The Thin-Film Oxygen Uptake (TFOUT) test (ASTM 4742) evaluates the oxidation stability of engine oils for gasoline automotive engines. This test, run at 160° C., utilizes a high pressure reactor pressurized with oxygen along with a metal catalyst package, a fuel catalyst, and water in a partial simulation of the conditions to which an oil may be subjected in a gasoline combustion engine. The oxidation stability of the lubricating oil composition of the present invention further containing a sulfur-containing compound is shown in Table 7. The results are compared to the lubricating oil composition of the present invention without the inclusion of a sulfur-containing compound (baseline). The longer the time in minutes the better the lubricating oil composition is at withstanding oxidation.

TABLE 7

| TFOUT Test[a] | | |
|---|---|---|
| Sulfur-Containing Compound | % Sulfur Content | TFOUT, minutes |
| Sulfurized vegetable/lard oil | 12 | 27 |
| Glycerol trioleate/octyl oleate, sulfurized at 10% plus 0.5% mercaptobenzothiazole | 10 | 48 |
| Sulfurized corn oil | 11 | 50 |
| Methylenebis(dibutyldithiocarbamate) | 30 | 183 |
| Zinc dibutyldithiocarbamate | 27 | 260 |

[a]0.15 wt %, on a sulfur basis, of each sulfur-containing compound was individually evaluated in a baseline 5W-20 formulation having the following composition:
45 milliMoles HOB Ca Sulfonate (TBN 426 calcium alkyl aryl sulfonate derived from benzene and $C_{20}$-$C_{24}$ normal alpha olefin).
0.2 wt % Oxymolybdenum complex (sulfurized molybdenum succinimide complex, expressed as active ingredient).
0.3 wt % Friction Modifier (borated glycerol monooleate as disclosed in U.S. Pat. No. 5,629,272).
1.0 wt % Diphenylamine-type Antioxidant (alkylated diphenylamine).

The balance of the lubricating oil composition contains a Group II base oil and minor other components such as foam inhibitors, viscosity index improvers, pour point depressants, dispersants, low overbased detergent, mixture of primary and secondary zinc dialkyldithiophosphates providing less than 0.08 wt % phosphorus content, based on the total weight of oil lubricating oil composition.

The results of the TFOUT test demonstrate that the oxidation stability varies considerably for the type of sulfur-containing compound used. On the basis of these results, methylenebis(dibutyldithiocarbamate) and zinc dibutyidithiocarbamate are highly effective in preventing oxidation in the TFOUT test.

What is claimed is:

1. A lubricating oil composition comprising:

a) major amount of a base oil of lubricating viscosity;

b) from about 0.1 to 10 wt % of an overbased alkaline earth metal alkyl aryl sulfonate detergent having a total base number (TBN) of about 25 to 500;

c) from about 0.02 to 10 wt % of a oxymolybdenum-containing complex of a nitrogen-containing compound;

d) from about 0.1 to 5.0 wt % of an ester friction modifier; and e) from about 0.2 to 10.0 wt % of an antioxidant selected from the group consisting of a diphenylamine type, a sulfur-containing compound and mixtures thereof;

wherein the total concentration of the oxymolybdenum-containing complex and antioxidant must be at least 1.3 wt %, based on the total weight of the lubricating oil composition and wherein the phosphorus content of the total lubricating oil composition is 0.08 wt % or less, based on the total weight of the lubricating oil composition.

2. The lubricating oil composition according to claim 1, wherein the total concentration of the oxymolybdenum-containing complex and the antioxidant must be at least 1.45 wt %, based on the total concentration of the lubricating oil composition.

3. The lubricating oil composition according to claim 1, wherein the phosphorus content is 0.06 wt % or less, based on the total weight of the lubricating oil composition.

4. The lubricating oil composition according to claim 1, wherein the phosphorus content is 0.05 wt % or less, based on the total weight of the lubricating oil composition.

5. The lubricating oil composition according to claim 1, wherein the alkaline earth metal is calcium.

6. The lubricating oil composition according to claim 1, wherein the sulfonate detergent is derived from a $C_{14-40}$ carbon linear normal alpha olefin wherein at least 13 mole percent of the alkyl group is attached at the 1 or 2 position of the alkyl group to the aryl group.

7. The lubricating oil composition according to claim 1, wherein the TBN of the sulfonate detergent is from about 250 to 500.

8. The lubricating oil composition according to claim 1, wherein the TBN of the sulfonate detergent is from about 300 to 450.

9. The lubricating oil composition according to claim 1, further comprising an oil-soluble, phosphorus-containing, anti-wear compound.

10. The lubricating oil composition according to claim 9, wherein the oil-soluble, phosphorus-containing, anti-wear compound is selected form the group consisting of metal dithiophosphates, phosphorus esters, amine phosphates and amine phosphinates, sulfur-containing phosphorus esters, phosphoramides, and phosphonamides.

11. The lubricating oil composition according to claim 10, wherein the phosphorus esters are selected from the group consisting of phosphates, phosphonates, phosphinates, phosphine oxides, phosphites, phosphonites, phosphinites, and phosphines.

12. The lubricating oil composition according to claim 10, wherein the sulfur-containing phosphorus esters are selected from the group consisting of phosphoro monothionate and phosphoro dithionates.

13. The lubricating oil composition according to claim 10, wherein the oil-soluble, phosphorus-containing, anti-wear compound is a metal dithiophosphate.

14. The lubricating oil composition according to claim 13, wherein the metal dithiophosphate is zinc dialkyldithiophosphate.

15. The lubricating oil composition according to claim 1, wherein the nitrogen-containing compound employed in the oxymolybdenum-containing complex is selected from the group consisting of succinimides, carboxylic acids amides, hydrocarbyl monoamines, hydrocarbon polyamines, Mannich bases, phosphoramides, thiophosphoramides, phosphonamides, dispersant viscosity index improvers, and mixtures thereof.

16. The lubricating oil composition according to claim 15, wherein the nitrogen-containing compound is a succinimide and the oxymolybdenum-containing complex is a molybdenum succinimide.

17. The lubricating oil composition according to claim 16, wherein the molybdenum succinimide is a sulfurized molybdenum succinimide.

18. The lubricating oil composition according to claim 16, wherein the molybdenum succinimide is an unsulfurized molybdenum succinimide.

19. The lubricating oil composition according to claim 1, wherein the ester friction modifier is a borated glycerol monooleate ester.

20. The lubricating oil composition according to claim 1, wherein the antioxidant is a diphenylamine-type antioxidant.

21. The lubricating oil composition according to claim 20, wherein the diphenylamine-type antioxidant is selected from the group consisting of alkylated diphenylamine, phenyl-α-naphthylamine, and alkylated-α-naphthylamine.

22. The lubricating oil composition according to claim 20, wherein the diphenylamine-type antioxidant is an alkylated diphenylamine.

23. The lubricating oil composition according to claim 1, wherein the antioxidant is a sulfur-containing compound.

24. The lubricating oil composition according to claim 23, wherein the sulfur-containing compound is selected from the group consisting of a sulfurized ester compound, a sulfurized olefin, and a dithiocarbamate.

25. The lubricating oil composition according to claim 23, wherein the sulfur-containing compound is a dithiocarbamate.

26. The lubricating oil composition according to claim 1, further comprising an alkenyl succinimide dispersant derived from about 450 to 3000 average molecular weight polyalkylene.

27. The lubricating oil composition according to claim 26, wherein the polyalkylene is polyisobutenyl having an average molecular weight of from about 900 to 2300.

28. The lubricating oil composition according to claim 27, wherein the polyisobutenyl succinimide is post-treated with ethylene carbonate.

29. A method of improving the fuel economy of a gasoline internal combustion engine comprising operating said engine with a lubricating oil composition comprising:

a) a major amount of a base oil of lubricating viscosity;

b) from about 0.1 to 10 wt % of an overbased alkaline earth metal alkyl aryl sulfonate detergent having a TBN of about 25 to 500;

c) from about 0.02 to 10 wt % of a oxymolybdenum-containing complex of a nitrogen-containing compound;

d) from about 0.1 to 5.0 wt % of an ester friction modifier; and e) from about 0.2 to 10 wt % of an antioxidant selected from the group consisting of a diphenylamine type, a sulfur-containing compound and mixtures thereof;

wherein the total concentration of the oxymolybdenum-containing complex and antioxidant must be at least 1.3 wt %, based on the total weight of the lubricating oil composition and wherein the phosphorus content of the total lubricating oil composition is 0.08 wt % or less, based on the total weight of the lubricating oil composition.

30. The method according to claim 29, wherein the total concentration of the oxymolybdenum-containing complex and the antioxidant must be at least 1.45 wt %.

31. The method according to claim 29, wherein the phosphorus content is 0.06 wt % or less, based on the total weight of the lubricating oil composition.

32. The method according to claim 29, wherein the phosphorus content is 0.05 wt % or less, based on the total weight of the lubricating oil composition.

33. The method according to claim 29, wherein the alkaline earth metal is calcium.

34. The method according to claim 29, wherein the sulfonate detergent is derived from a $C_{14-40}$ carbon linear normal alpha olefin wherein at least 13 mole percent of the alkyl group is attached at the 1 or 2 position of the alkyl group to the aryl group.

35. The method according to claim 29, wherein the TBN of the sulonate detergent is from about 250 to 500.

36. The method according to claim 29, wherein the TBN of the sulfonate detergent is from about 300 to 450.

37. The method according to claim 29, further comprising an oil-soluble, phosphorus-containing, anti-wear compound.

38. The method according to claim 37, wherein the oil-soluble, phosphorus-containing, anti-wear compound is selected form the group consisting of metal dithiophosphates, phosphorus esters, amine phosphates and amine phosphinates, sulfur-containing phosphorus esters, phosphoramides, and phosphonamides.

39. The method according to claim 38, wherein the phosphorus esters are selected from the group consisting of phosphates, phosphonates, phosphinates, phosphine oxides, phosphites, phosphonites, phosphinites, and phosphines.

40. The method according to claim 38, wherein the sulfur-containing phosphorus esters are selected from the group consisting of phosphoro monothionate and phosphoro dithionates.

41. The method according to claim 37, wherein the oil-soluble, phosphorus-containing, anti-wear compound is a metal dithiophosphate.

42. The method according to claim 41, wherein the metal dithiophosphate is zinc dialkyldithiophosphate.

43. The method according to claim 39, wherein the nitrogen-containing compound employed in the oxymolybdenum-containing complex is selected from the group consisting of succinimides, carboxylic acids amides, hydrocarbyl monoamines, hydrocarbon polyamines, Mannich bases, phosphoramides, thiophosphoramides, phosphonamides, dispersant viscosity index improvers, and mixtures thereof.

44. The method according to claim 43, wherein the nitrogen-containing compound is a succinimide and the oxymolybdenum-containing complex is a molybdenum succinimide.

45. The method according to claim 44, wherein the molybdenum succinimide is a sulfurized molybdenum succinimide.

46. The method according to claim 44, wherein the molybdenum succinimide is an unsulfurized molybdenum succinimide.

47. The method according to claim 39, wherein the ester friction modifier is a borated glycerol monooleate ester.

48. The method according to claim 39, wherein the antioxidant is a diphenylamine-type antioxidant.

49. The method according to claim 48, wherein the diphenylamine-type antioxidant is selected from the group consisting of alkylated diphenylamine, phenyl-α-naphthylamine, and alkylated-α-naphthylamine.

50. The method according to claim 48, wherein the diphenylamine-type antioxidant is an alkylated diphenylamine.

51. The method according to claim 39, wherein the antioxidant is a sulfur-containing compound.

52. The method according to claim 51, wherein the sulfur-containing compound is selected from the group consisting of a sulfurized ester compound, a sulfurized olefin, and a dithiocarbamate.

53. The method according to claim 51, wherein the sulfur-containing compound is a dithiocarbamate.

54. The method according to claim 39, further comprising an alkenyl succinimide dispersant derived from about 450 to 3000 average molecular weight polyalkylene.

55. The method according to claim 54, wherein the polyalkylene is polyisobutenyl having an average molecular weight of from about 900 to 2300.

56. The method according to claim 55, wherein the polyisobutenyl succinimide is post-treated with ethylene carbonate.

* * * * *